US006454374B1

(12) United States Patent
Therien

(10) Patent No.: US 6,454,374 B1
(45) Date of Patent: Sep. 24, 2002

(54) UNI-DIRECTIONAL WASTE INK REMOVAL SYSTEM

(75) Inventor: Patrick Therien, Battle Ground, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 17 days.

(21) Appl. No.: 09/773,881

(22) Filed: Jan. 31, 2001

(51) Int. Cl.[7] ..... B41J 2/01
(52) U.S. Cl. ..... 347/1; 347/33
(58) Field of Search ..... 347/1, 22–36, 347/19, 6, 81; 15/250.361, 256.5; 346/25

(56) References Cited

U.S. PATENT DOCUMENTS

| | | | | |
|---|---|---|---|---|
| 4,074,217 A | * | 2/1978 | Yanagawa | 355/30 |
| 4,310,846 A | | 1/1982 | Horike | 347/6 |
| 4,323,905 A | | 4/1982 | Reitberger et al. | 347/6 |
| 4,333,083 A | | 6/1982 | Aldridge | 347/81 |
| 5,036,340 A | | 7/1991 | Osborne | 347/19 |
| 5,109,239 A | | 4/1992 | Cobbs et al. | 347/19 |
| 5,255,009 A | * | 10/1993 | Bauer et al. | 346/25 |
| 5,949,448 A | | 9/1999 | Man et al. | 347/53 |
| 6,086,190 A | | 7/2000 | Schantz et al. | 347/81 |
| 6,094,981 A | | 8/2000 | Hochstein | 73/170.17 |
| 6,155,667 A | | 12/2000 | Eckard et al. | 347/33 |

FOREIGN PATENT DOCUMENTS

JP 06-238906 * 8/1994

OTHER PUBLICATIONS

Hewlett–Packard Company, U.S. Patent Application Serial No. 09/560,430, filed Apr. 28, 2000, entitled "Electrical Interconnect Cleaning System for Inkjet Cartridges".

* cited by examiner

*Primary Examiner*—Anh T. N. Vo
*Assistant Examiner*—Shih-wen Hsieh
(74) *Attorney, Agent, or Firm*—Christopher B. Miller

(57) ABSTRACT

A uni-directional waste ink removal system cleans ink residue from an electrostatic sensing element of an ink drop detector in a printing mechanism when the electrostatic sensing element, supported by a base, is actuated between an activated position, a storage position, and back to the activated position. The system also includes a scraper and an absorber which first contact the sensing element when the base is in the storage position, thereby ensuring ink residue may be absorbed, and that ink residue is only scraped from the sensing element in one direction as the base is moved to the activated position. A method of cleaning ink residue from an electrostatic sensing element of an ink drop detector, and a printing mechanism having such a unidirectional waste ink removal system are also provided.

19 Claims, 5 Drawing Sheets

UNI-DIRECTIONAL WASTE INK REMOVAL SYSTEM

INTRODUCTION

The present invention relates generally to printing mechanisms, such as inkjet printers or inkjet plotters. More particularly the present invention relates to a unidirectional waste ink removal system for cleaning ink residue and debris from a target area of an ink drop detector in a printing mechanism.

Printing mechanisms often include an inkjet printhead which is capable of forming an image on many different types of media. The inkjet printhead ejects droplets of colored ink through a plurality of orifices and onto a given media as the media is advanced through a printzone. The printzone is defined by the plane created by the printhead orifices and any scanning or reciprocating movement the printhead may have back-and-forth and perpendicular to the movement of the media. Conventional methods for expelling ink from the printhead orifices, or nozzles, include piezo-electric and thermal techniques which are well-known to those skilled in the art. For instance, two earlier thermal ink ejection mechanisms are shown in U.S. Pat. Nos. 5,278,584 and 4,683,481, both assigned to the present assignee, Hewlett-Packard Company.

In a thermal system, a barrier layer containing ink channels and vaporization chambers is located between a nozzle orifice plate and a substrate layer. This substrate layer typically contains linear arrays of heater elements, such as resistors, which are individually addressable and energized to heat ink within the vaporization chambers. Upon heating, an ink droplet is ejected from a nozzle associated with the energized resistor. The inkjet printhead nozzles are typically aligned in one or more linear arrays substantially parallel to the motion of the print media as the media travels through the printzone. The length of the linear nozzle arrays defines the maximum height, or "swath" height of an imaged bar that would be printed in a single pass of the printhead across the media if all of the nozzles were fired simultaneously and continuously as the printhead was moved through the printzone above the media.

Typically, the print media is advanced under the inkjet printhead and held stationary while the printhead passes along the width of the media, firing its nozzles as determined by a controller to form a desired image on an individual swath, or pass. The print media is usually advanced between passes of the reciprocating inkjet printhead in order to avoid uncertainty in the placement of the fired ink droplets. If the entire printable data for a given swath is printed in one pass of the printhead, and the media is advanced a distance equal to the maximum swath height in-between printhead passes, then the printing mechanism will achieve its maximum throughput.

Often, however, it is desirable to print only a portion of the data for a given swath, utilizing a fraction of the available nozzles and advancing the media a distance smaller than the maximum swath height so that the same or a different fraction of nozzles may fill in the gaps in the desired printed image which were intentionally left on the first pass. This process of separating the printable data into multiple passes utilizing subsets of the available nozzles is referred to by those skilled in the art as "shingling," "masking," or using "print masks." While the use of print masks does lower the throughput of a printing system, it can provide offsetting benefits when image quality needs to be balanced against speed. For example, the use of print masks allows large solid color areas to be filled in gradually, on multiple passes, allowing the ink to dry in parts and avoiding the large-area soaking and resulting ripples, or "cockle", in the print media that a single pass swath would cause.

A printing mechanism may have one or more inkjet printheads, corresponding to one or more colors. For example, a typical inkjet printing system may have a single printhead with only black ink; or the system may have four printheads, one each with black, cyan, magenta, and yellow inks; or the system may have three printheads, one each with cyan, magenta, and yellow inks. Of course, there are many more combinations and quantities of possible printheads in inkjet printing systems, including seven and eight ink/printhead systems.

Each process color ink is ejected onto the print media in such a way that the drop size, relative position of the ink drops, and color of a small, discreet number of process inks are integrated by the naturally occurring visual response of the human eye to produce the effect of a large colorspace with millions of discernable colors and the effect of a nearly continuous tone. In fact, when these imaging techniques are performed properly by those skilled in the art, near-photographic quality images can be obtained on a variety of print media using only three to eight colors of ink.

This high level of image quality depends on many factors, several of which include: consistent and small ink drop size, consistent ink drop trajectory from the printhead nozzle to the print media, and extremely reliable inkjet printhead nozzles which do not clog.

To this end, many inkjet printing mechanisms contain a service station for the maintenance of the inkjet printheads. These service stations may include wipers, ink-solvent applicators, primers, and caps to help keep the nozzles from drying out during periods of inactivity. Additionally, inkjet printing mechanisms often contain service algorithms which are designed to fire ink out of each of the nozzles and into a waste spittoon in order to prevent nozzle clogging.

Despite these preventative measures, however, there are many factors at work within the typical inkjet printing mechanism which may clog the inkjet nozzles, and inkjet nozzle failures may occur. For example, paper dust may collect on the nozzles and eventually clog them. Ink residue from ink aerosol or partially clogged nozzles may be spread by service station printhead wipers into open nozzles, causing them to be clogged. Accumulated precipitates from the ink inside of the printhead may also occlude the ink channels and the nozzles. Additionally, the heater elements in a thermal inkjet printhead may fail to energize, despite the lack of an associated clogged nozzle, thereby causing the nozzle to fail.

Clogged printhead nozzles result in objectionable and easily noticeable print quality defects such as banding (visible bands of different hues or colors in what would otherwise be a uniformly colored area) or voids in the image. In fact, inkjet printing systems are so sensitive to clogged nozzles, that a single clogged nozzle out of hundreds of nozzles is often noticeable and objectionable in the printed output.

It is possible, however, for an inkjet printing system to compensate for a missing nozzle by removing it from the printing mask and replacing it with an unused nozzle or a used nozzle on a later, overlapping pass, provided the inkjet system has a way to tell when a particular nozzle is not functioning. In order to detect whether an inkjet printhead nozzle is firing, a printing mechanism may be equipped with a number of different ink drop detector systems.

One type of ink drop detector system utilizes a piezoelectric target surface that produces a measurable signal when ink droplets contact the target surface. Unfortunately, however, this type of technology is expensive and often is unable to detect the extremely small drops of ink used in inkjet printing systems with photographic image quality.

Another type of ink drop detector utilizes an optical sensor which forms a measurable signal when an ink droplet passes through a light beam from a sensory circuit. Unfortunately, this method is subject to extremely tight alignment tolerances which are difficult and expensive to setup and maintain. Additionally, an optical ink drop detection system is susceptible to the ink aerosol which results from the firing of the inkjet printhead inside of the printing mechanism. The aerosol coats the optical sensor over time, degrading the optical sensor signal and eventually preventing the optical sensor from functioning.

A more effective solution for ink drop detection is to use a low cost ink drop detection system, such as the one described in U.S. Pat. No. 6,086,190 assigned to the present assignee, the Hewlett-Packard Company. This drop detection system utilizes an electrostatic sensing element which is imparted with an electrical stimulus when struck by a series of ink drop bursts ejected from an inkjet printhead. The electrostatic sensing element may be made sufficiently large so that printhead alignment is not critical, and the sensing element may function with amounts of ink or aerosol on the sensing element surface which would incapacitate other types of drop detection sensors.

In practical implementation, however, this electrostatic sensing element has some limitations. First, successive drops of ink, drying on top of one another quickly form stalagmites of dried ink which may grow toward the printhead. Since it is preferable to have the electrostatic sensing element very close to the printhead for more accurate readings, these stalagmites may eventually interfere with or permanently damage the printhead, adversely affecting print quality. Second, as the ink residue dries, it remains conductive and may short out the drop detector electronics as the ink residue grows and spreads. Thus, this dried residue impairs the ability of the sensor to measure the presence of drops properly.

Thus, it would be desirable to have a method and mechanism for effectively removing the waste ink residue from an electrostatic ink drop detector in an inkjet printing mechanism.

SUMMARY OF THE INVENTION

According to one aspect of the present invention, a waste ink removal system is provided for cleaning ink residue from an ink drop detection sensor in a printing mechanism. The waste ink removal system includes a frame, a base which supports the sensor and which is slideably supported by the frame, and an actuator which moves the base between an activated position and a storage position. The waste ink removal system also includes an absorber pivotally supported by the frame, to selectively contact the sensor and remove ink residue therefrom when the sensor is in the storage position. The waste ink removal system additionally includes a scraper pivotally supported by the frame to scrape ink residue from the sensor as the base moves from the storage position to the activated position.

According to another aspect of the present invention, a printing mechanism may be provided with a waste ink removal system as described above.

According to a further aspect of the present invention, a method is provided for cleaning ink residue from an ink drop detection sensor in a printing mechanism. The method includes transitioning the sensor from a storage position to an activated position, thereafter, depositing ink on the sensor and accumulating ink residue thereon. The method thereafter includes retracting the sensor to the storage position, and thereafter, absorbing the ink residue from the sensor. Finally, the method includes, returning the sensor from the storage position to the activated position.

One goal of the present invention is to provide a unidirectional waste ink removal system for cleaning ink residue from the sensing element of an electrostatic ink drop detector to prevent ink build-up on the sensor from contacting and thereby damaging the printheads, as well as to ensure a clean sensor surface to enable accurate drop detection readings that can be used to provide consumers with a reliable, economical inkjet printing unit.

BRIEF DESCRIPTION OF THE DRAWINGS

FIGS. 4–7 are enlarged, fragmented side elevational views of the service station of FIG. 1, specifically with:

FIG. 4 showing a scraper lifting as the electrostatic ink drop detector moves towards the unidirectional waste ink removal system;

FIG. 5 showing the electrostatic ink drop detector moving below the scraper of the unidirectional waste ink removal system;

FIG. 6 showing an absorber in contact with the electrostatic ink drop detector; and FIG. 7 showing the scraper performing a unidirectional scraping of the electrostatic ink drop detector.

DETAILED DESCRIPTION OF THE PREFERRED EMBODIMENTS

Figure 1:
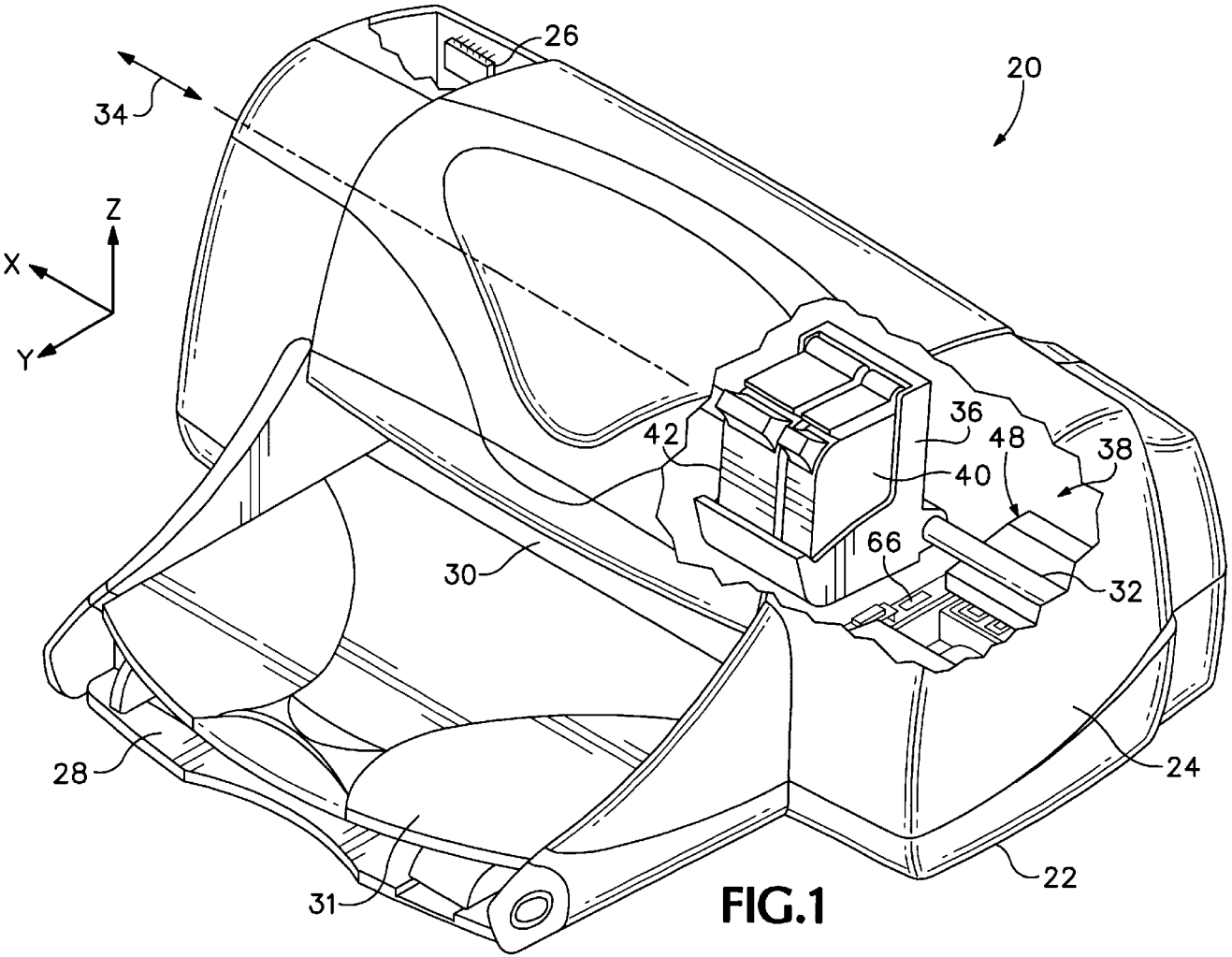
FIG. 1 is a fragmented perspective view of one form of an inkjet printing mechanism, here including a service station having an electrostatic ink drop detector with a unidirectional waste ink removal system.

FIG. 1 illustrates an embodiment of a printing mechanism, here shown as an inkjet printer 20, constructed in accordance with the present invention, which may be used for printing on a variety of media, such as paper, transparencies, coated media, cardstock, photo quality papers, and envelopes in an industrial, office, home or other environment. A variety of inkjet printing mechanisms are commercially available. For instance, some of the printing mechanisms that may embody the concepts described herein include desk top printers, portable printing units, wide-format printers, hybrid electrophotographic-inkjet printers, copiers, cameras, video printers, and facsimile machines, to name a few. For convenience the concepts introduced herein are described in the environment of an inkjet printer 20.

While it is apparent that the printer components may vary from model to model, the typical inkjet printer 20 includes a chassis 22 surrounded by a frame or casing enclosure 24, typically of a plastic material. The printer 20 also has a printer controller, illustrated schematically as a microprocessor 26, that receives instructions from a host device, such as a computer or personal data assistant (PDA) (not shown). A screen coupled to the host device may also be used to display visual information to an operator, such as the printer status or a particular program being run on the host device. Printer host devices, such as computers and PDA's, their input devices, such as a keyboards, mouse devices, stylus devices, and output devices such as liquid crystal display screens and monitors are all well known to those skilled in the art.

A conventional print media handling system (not shown) may be used to advance a sheet of print media (not shown) from the media input tray 28 through a printzone 30 and to an output tray 31. A carriage guide rod 32 is mounted to the chassis 22 to define a scanning axis 34, with the guide rod 32 slideably supporting an inkjet carriage 36 for travel back and forth, reciprocally, across the printzone 30. A conventional carriage drive motor (not shown) may be used to propel the carriage 36 in response to a control signal received from the controller 26. To provide carriage positional feedback information to controller 26, a conventional encoder strip (not shown) may be extended along the length of the printzone 30 and over a servicing region 38. A conventional optical encoder reader may be mounted on the back surface of printhead carriage 36 to read positional information provided by the encoder strip, for example, as described in U.S. Pat. No. 5,276,970, also assigned to the Hewlett-Packard Company, the present assignee. The manner of providing positional feedback information via the encoder strip reader, may also be accomplished in a variety of ways known to those skilled in the art.

In the printzone 30, the media sheet receives ink from an inkjet cartridge, such as a black ink cartridge 40 and a color inkjet cartridge 42. The cartridges 40 and 42 are also often called "pens" by those in the art. The black ink pen 40 is illustrated herein as containing a pigment-based ink. For the purposes of illustration, color pen 42 is described as containing three separate dye-based inks which are colored cyan, magenta, and yellow, although it is apparent that the color pen 42 may also contain pigment-based inks in some implementations. It is apparent that other types of inks may also be used in the pens 40 and 42, such as paraffin-based inks, as well as hybrid or composite inks having both dye and pigment characteristics. The illustrated printer 20 uses replaceable printhead cartridges where each pen has a reservoir that carries the entire ink supply as the printhead reciprocates over the printzone 30. As used herein, the term "pen" or "cartridge" may also refer to an "off-axis" ink delivery system, having main stationary reservoirs (not shown) for each ink (black, cyan, magenta, yellow, or other colors depending on the number of inks in the system) located in an ink supply region. In an off-axis system, the pens may be replenished by ink conveyed through a conventional flexible tubing system from the stationary main reservoirs which are located "off-axis" from the path of printhead travel, so only a small ink supply is propelled by carriage 36 across the printzone 30. Other ink delivery or fluid delivery systems may also employ the systems described herein, such as "snapper" cartridges which have ink reservoirs that snap onto permanent or semi-permanent print heads.

The illustrated black pen 40 has a printhead 44, and color pen 42 has a tri-color printhead 46 which ejects cyan, magenta, and yellow inks. The printheads 44, 46 selectively eject ink to form an image on a sheet of media when in the printzone 30. The printheads 44, 46 each have an orifice plate with a plurality of nozzles formed therethrough in a manner well known to those skilled in the art. The nozzles of each printhead 44, 46 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 34, with the length of each array determining the maximum image swath for a single pass of the printhead. The printheads 44, 46 are thermal inkjet printheads, although other types of printheads may be used, such as piezoelectric printheads. The thermal printheads 44, 46 typically include a plurality of resistors which are associated with the nozzles. Upon energizing a selected resistor, a bubble of gas is formed which ejects a droplet of ink from the nozzle and onto the print media when in the printzone 30 under the nozzle. The printhead resistors are selectively energized in response to firing command control signals delivered from the controller 26 to the printhead carriage 36.

Between print jobs, the inkjet carriage 36 moves along the carriage guide rod 32 to the servicing region 38 where a service station 48 may perform various servicing functions known to those in the art, such as, priming, scraping, and capping for storage during periods of non-use to prevent ink from drying and clogging the inkjet printhead nozzles.

Figure 2:
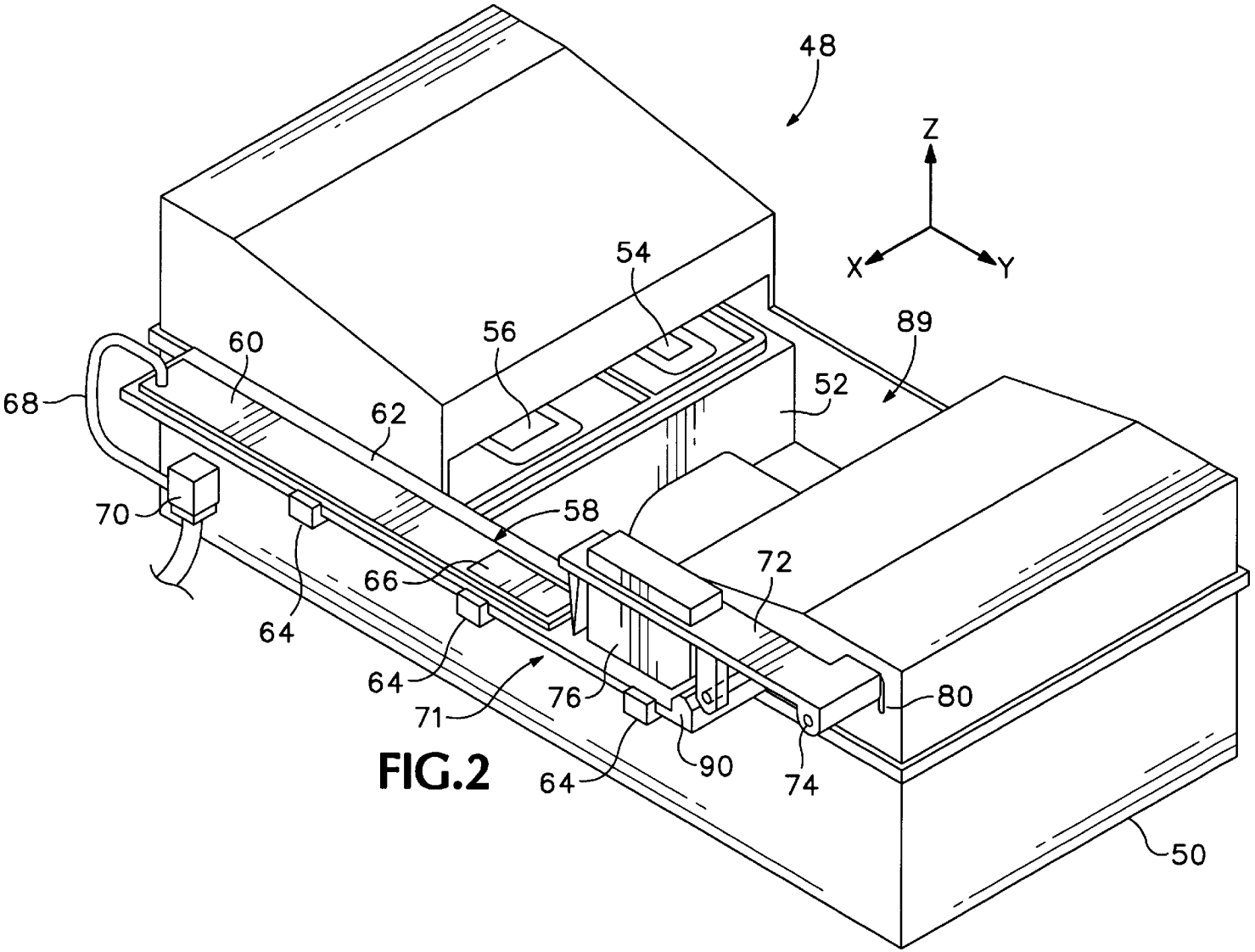
FIG. 2 is an enlarged perspective view of the service station from FIG. 1.

FIG. 2 shows the service station 48 in detail. A service station frame 50 is mounted to the chassis 22, and houses a moveable pallet 52. The moveable pallet 52 may be driven by a motor (not shown) to move in the frame 50 in the positive and negative Y-axis directions. The moveable pallet 52 may be driven by a rack and pinion gear powered by the service station motor in response to the microprocessor 26 according to methods known by those skilled in the art. An example of such a rack and pinion system in an inkjet cleaning service station can be found in U.S. Pat. No. 5,980,018, assigned to the Hewlett-Packard Company, also the current assignee. The end result is that pallet 52 may be moved in the positive Y-axis direction to a servicing position and in the negative Y-axis direction to an uncapped position. The pallet 52 supports a black printhead cap 54 and a tricolor printhead cap 56 to seal the printheads 44 and 46, respectively, when the moveable pallet 52 is in the servicing position, here a capping position.

FIG. 2 also shows an ink drop detector system 58 supported by the service station frame 50. Clearly, the ink drop detector system 58 could be mounted in other locations along the printhead scanning axis 34, including the right side of the service station frame 50, inside the service station 48, or the opposite end of the printer from the service station 48, for example. However, the illustrated location of the ink drop detector 58 is the preferred location, and will be used to illustrate the preferred principles of manufacture and operation, although other locations may be more suitable in other implementations.

The ink drop detector 58 has a printed circuitboard assembly (PCA) 60 which is supported by a PCA carrier 62. The PCA carrier 62 is slideably supported by carrier guide arms 64 and the service station frame 50 which allows the PCA carrier 62, freedom of movement in positive and negative Y-axis directions. The PCA 60 has a conductive electrostatic sensing element 66, or "target" on the upper surface toward which ink droplets may be fired and detected according to the apparatus and method described in U.S. Pat. No. 6,086,190, assigned to the Hewlett-Packard Company, the present assignee. The PCA 60 contains various electronics (not shown) for filtering and amplification of drop detection signals received from the target 66. A flex cable 68 and an electrical conductor 70 link the ink drop detector 58 to controller 26 for drop detection signal processing. The ink drop detector system 58 also has an associated unidirectional waste ink removal system 71.

A scraper arm 72 is pivotally attached to a scraper pivot post 74 which projects outwardly from the service station frame 50. The scraper arm supports an absorbing member, such as absorber 76 and a scraper member, such as scraper 78. The absorber 76 is preferably constructed of fibrous medium and may be sized for the required life of the ink drop detector 58. A torsion spring 80 is connected between the service station frame 50 and the scraper arm 72, to bias the scraper arm 72 towards the PCA carrier 62 in the negative Z-axis direction.

Figure 3:
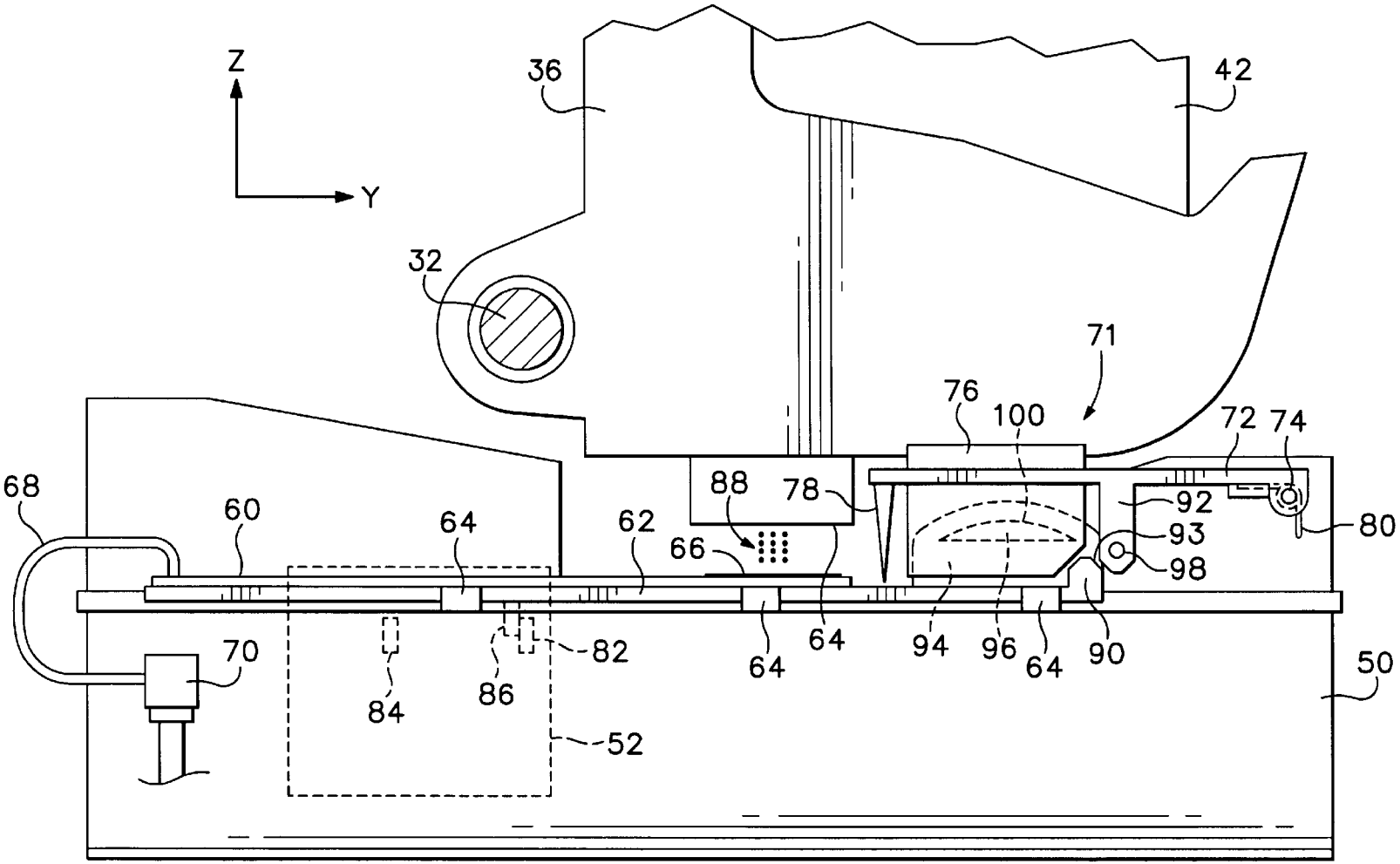
FIG. 3 is an enlarged side elevational view of the service station of FIG. 1 shown with an inkjet printhead firing ink onto an electrostatic ink drop detector.
Figure 5:
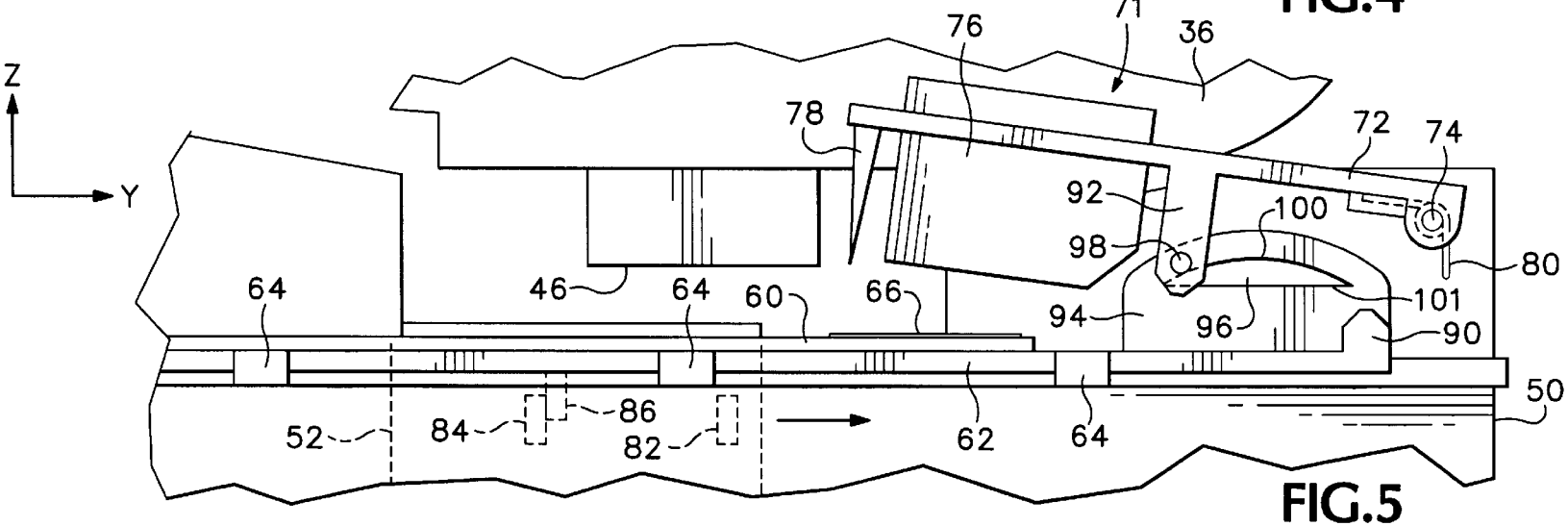
Figure 6:
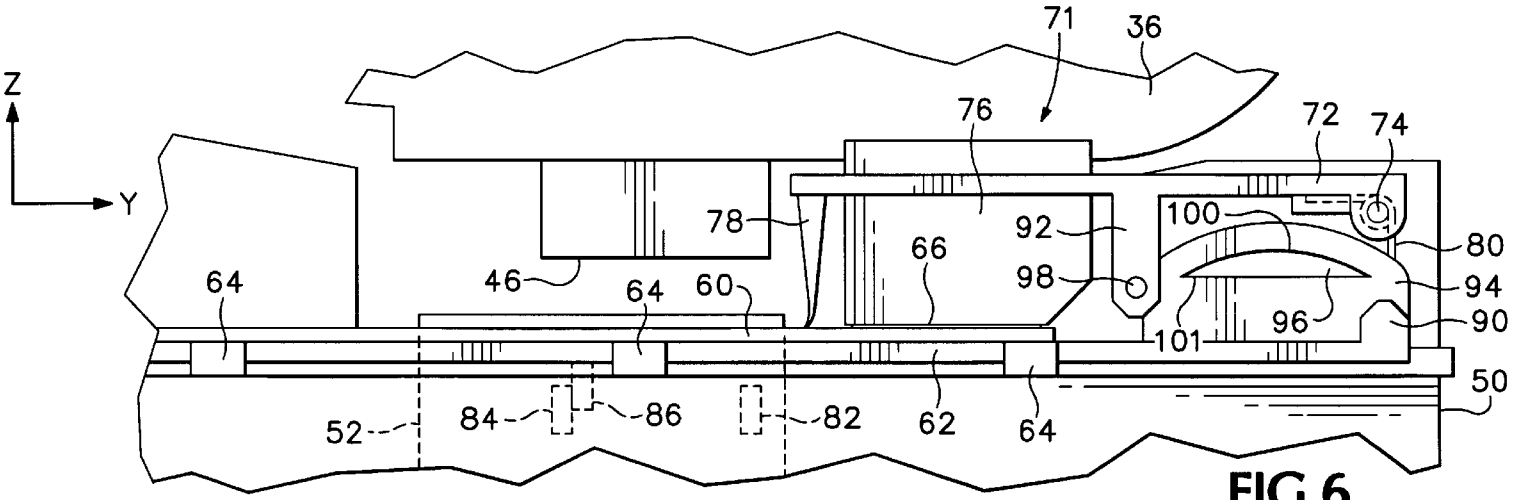

Movement is preferably imparted to the PCA carrier 62 through translation of the moveable pallet 52 as the pallet 52 moves from the uncapped position shown in FIG. 3 to the capped position shown in FIG. 6. FIGS. 3–7 show a front moveable pallet arm 82 and a rear moveable pallet arm 84 which protrude outwardly from the moveable pallet 52 on the side of the pallet 52 adjacent to the PCA carrier 62. A PCA carrier leg 86, which is integral to the PCA carrier 62, protrudes inwardly towards the moveable pallet 52. The rear moveable pallet arm 84 is sized and positioned to engage the PCA carrier leg 86 as the moveable pallet 52 is moved from the uncapped position of FIG. 3 to the capped position of FIG. 6. Thus, the PCA carrier 62 may be moved in the positive Y-axis direction when the rear moveable pallet arm 84 engages the carrier leg 86. When the PCA carrier 62 finishes traveling in the positive Y-axis direction, the PCA carrier 62 is said to be in a storage position.

The moveable pallet 52 may then be moved oppositely, in the negative Y-axis direction. When this pallet 52 movement begins, the PCA carrier 62 remains stationary until the front moveable pallet arm 82 contacts the carrier leg 86. Once this contact occurs, the PCA carrier 62 moves with the pallet 52 in the negative Y-axis direction. When the PCA carrier 62 finishes traveling in the negative Y-axis direction, the PCA carrier 62 is said to be in an activated position, ready for sensing.

While the preferred method of actuating the PCA carrier 62 is through the above-described translation of moveable pallet 52, it should be apparent that other structural equivalents may be substituted to act as the actuator for the PCA carrier 62, including, for example, a solenoid or a motor which operate in response to the controller 26.

While the moveable pallet 52 is in the uncapped position, the PCA carrier 62 is in the activated position. While the PCA carrier 62 is in the activated position, the electrostatic sensing target 66 is positioned so that the inkjet carriage 36 may be moved along the carriage guide rod 32 until one or more of the printheads 44, 46 are positioned directly over the electrostatic sensing target 66. For illustration purposes, the tri-color printhead 46 is shown positioned over target 66 in FIG. 3, although it is apparent that either of the printheads 44, 46 may be positioned over the target 62 either one at a time or in various simultaneous combinations if allowed by the size of the target 66, the size of each printhead, and the spacing between the printheads.

The preferred spacing between the printheads 44, 46 and the target 66 is on the order of two millimeters, although other spacings may be more desirable in different implementations. Once the printhead 46 is properly aligned with the target 66, the controller 26 causes ink droplets 88 to be fired from printhead 46 onto the target 66. An electrical drop detect signal is generated by the ink droplets 88 as they contact the target 66, and this signal is captured by the electronics of PCA 60. The drop detect signal is then analyzed by controller 26 to determine whether or not various nozzles of printhead 46 are spitting ink properly or whether they are clogged. A preferred method of analyzing signals from an electrostatic target ink drop detector is shown in U.S. Pat. No. 6,086,190, also assigned to the present assignee, the Hewlett-Packard Company. A clogged nozzle may be purged by spitting ink into a spittoon portion 89 defined by the service station frame 50. Following a spitting routine, further drop detection by sensor 58 may determine that the nozzle is permanently clogged or otherwise damaged. Based on the determination made by the controller 26 as to whether each nozzle is functioning properly, the controller 26 may adjust the print masks to substitute functioning nozzles for any malfunctioning nozzles to provide consistent high-quality printed output while still using a printhead with permanently clogged nozzles.

In order to ensure that a reliable measurement may be made by the ink drop detector system 58, it is desirable to remove ink residue from the target 66 after a measurement or series of measurements have been made to prevent excessive deposits of dried ink from accumulating on the surface of target 66. Dried ink deposits remain conductive and may short circuit some of the electronics on PCA 60 if allowed to build-up and spread over time, thereby degrading the ability of the ink drop detector 58 to make measurements. Additionally, dried ink deposits may accumulate over time to form stalagmites which eventually grow to interfere with the printheads 44, 46, possibly damaging nozzles which hit the stalagmites, a process known as "stalagmite crashes."

Figure 4:
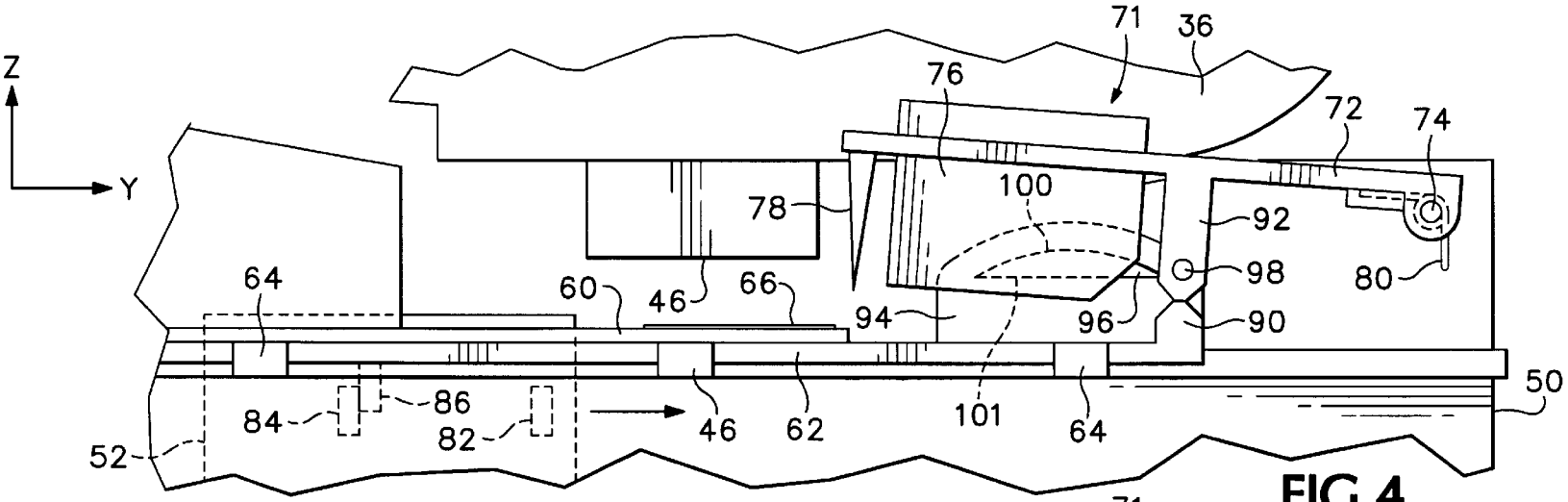

Accordingly, a mechanism is provided to lift the scraper arm 72, including the attached scraper 78 and the absorber 76, as the PCA carrier 62 is moved to the storage position by the moveable pallet 52, as shown in FIGS. 4–5. The PCA carrier 62 has a lifter 90 which protrudes upwardly from the front end of the PCA carrier 62 nearest to the scraper arm 72. The scraper arm 72 has a cam follower support 92 which protrudes downwardly from the scraper arm 72. The cam follower support 92 is preferably positioned on the scraper arm 72 between the absorber 76 and the scraper pivot 74, but nearest to the absorber 76 for increased mechanical advantage. As the PCA carrier 62 is moved towards the storage position, a forward surface 93 of the lifter 90, integral to the PCA carrier 62, is brought into interference with the cam follower support 92. As a result, the scraper arm 72 is lifted as shown in FIG. 4 to allow the target 66 to pass freely thereunder as shown in FIG. 5.

A cam wall 94 is also integrally formed as a continuous part of the PCA carrier 62. The cam wall 94 protrudes upwardly from the PCA carrier 62 in the positive Z-axis direction and is located on the side of the PCA carrier 62 facing towards the service station frame 50. The cam wall 94 is also sized in thickness to fit between the service station frame 50 and the absorber 76. On the side of the cam wall 94 facing the absorber 76, a cam 96 protrudes from the cam wall 94. This cam 96 does not interfere with the absorber 76. The cam wall 94, and therefore also the cam 96, move in unison with the PCA carrier 62.

As the PCA carrier 62 continues to move in the positive Y-axis direction, towards the storage position, a cam follower 98 on the scraper arm 72, shown in FIG. 4, is transferred to the cam 96 by the lifting motion of scraper arm 72 created by the above-described interference between the lifter 90 and the cam follower support 92. Since the torsion spring 80 is biasing the scraper arm 72 in the negative Z-axis direction, the cam follower 98 rides along an upper cam surface 100 of cam 96 as the cam wall 94 is moved in the positive Y-axis direction. As the cam follower 98 travels along the upper cam surface 100, the electrostatic sensing target 66 is being positioned beneath the raised scraper 78 and absorber 76, as shown in FIG. 5.

When the PCA carrier 62 reaches the storage position, the cam follower 98 clears the upper cam surface 100 and the scraper 78 pivots counterclockwise under forces provided by gravity and the torsion spring 80, into contact with the PCA 60, as shown in FIG. 6. With the scraper 78 in contact with the PCA 60, while the PCA carrier 62 is in the storage position, the absorber 76 is in overlapping contact with the electrostatic sensing target 66. This allows the absorber 76 to absorb ink which has been deposited on the target 66.

A printer control routine used by controller 26 is preferably adjusted to perform ink drop detection measurements just prior to capping. The immediately following process of moving the pallet 52 into the capping position, and therefore the PCA carrier 62 into the storage position, allows the absorber 76 to soak-up the ink residue from the target 66 while the ink is still wet. The waste ink is absorbed through capillary action, thereby minimizing the possibility that stalagmites or dried ink may form on the target 66.

The target 66 remains in contact with the absorber 76 while the printheads 44, 46 are sealed by caps 54, 56, allowing time for any wet ink which is present on the target 66 to be pulled into the absorber 76. In fact, prototype testing of the illustrated absorber 76 has shown that ink deposited on the absorber 76 through contact with the target 66 flows under capillary action throughout the absorber 76. Thus, the size of the absorber 76 may be designed to hold various volumes of ink, and preferably, enough ink to last at least over the expected lifetime of the printer 20.

Figure 7:
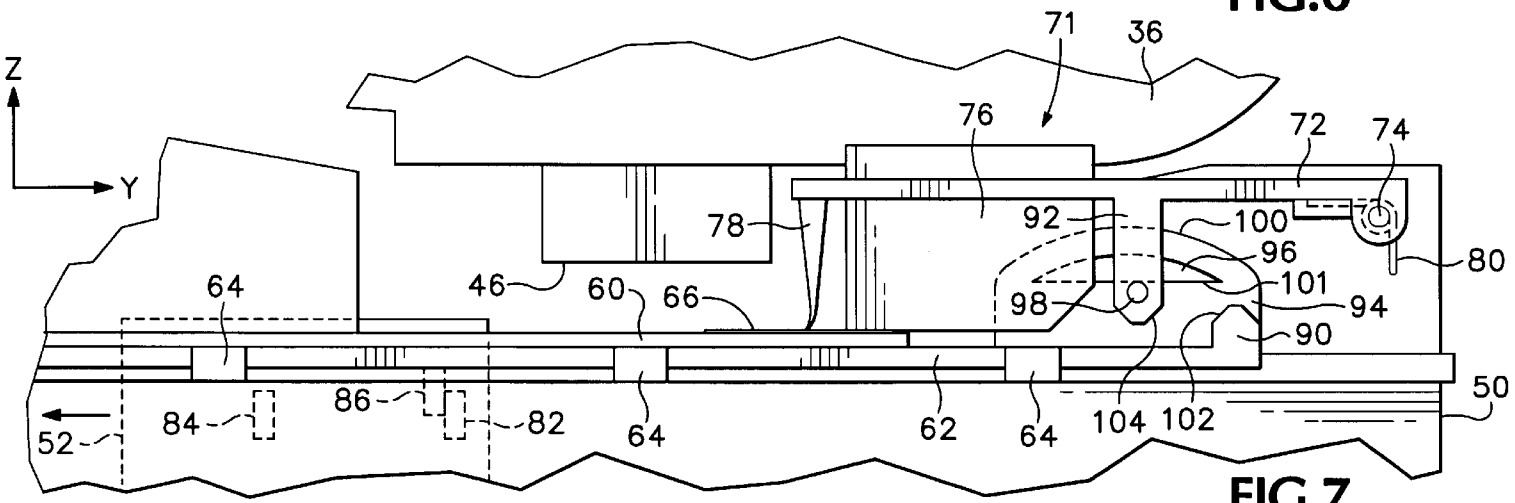

Despite efforts to remove the ink residue from the target 66 while it is still wet, dried ink debris may still be formed on target 66. To remove this dried ink debris, which the absorber 76 is not able to absorb, the scraper 78 is employed when the pallet 52 is moved to the uncapped position. While uncapping, the pallet 52 moves in the negative Y-axis direction, as shown in FIG. 7. The front moveable pallet arm 82 contacts the PCA carrier leg 86, which then moves the PCA carrier 62 in the negative Y-axis direction. The electrostatic sensing target 66 is thereby scraped by scraper 78, as shown in FIG. 7, as the PCA carrier 62 moves toward the activated position. During this move, the scraper stays in contact with the PCA 60 and the target 66 due to the downward bias from torsion spring 80. As the PCA carrier 62 moves to the activated position, the cam follower 98 passes clear of and below cam 96.

The scraper 78 and absorber 76 were lifted, and therefore not in contact with the target 66, when the PCA carrier 62 was moved to the storage position. Thus, the scraping action between scraper 78 and target 66 as the PCA carrier 62 is moved to the activated position ensures that the target is only scraped in one single direction. As the PCA carrier 62 moves to the activated position, cam follower 98 passes below a lower cam surface 101 of cam 96.

This uni-directional scraping system 71 provides a way to keep previously scraped ink debris, lodged on scraper 78, from being redeposited by the scraper 78 onto the target 66 as would be the case if the scraper arm 72 was never lifted. If the scraper arm 72 was never lifted, ink debris would accumulate on one side of the scraper 78 as the PCA carrier 62 moved to the storage position. Since the debris would have accumulated on the side of the scraper 78 where the target 66 would move to when the PCA carrier 62 returned to the activated position, the debris might be redeposited onto the target 66 during this second scraping in the opposite direction. Thus, this uni-directional scraping system 71 is preferred to maintain target cleanliness and promote consistent, reliable drop detection.

As the PCA carrier 62 nears the completely activated position, the lifter surface 102 of lifter 90 contacts the cam follower support surface 104 of the cam follower support 92. Since the lifter surface 102 and the cam follower support surface 104 are interfering, the cam follower support 92 is forced up and into the position shown in FIG. 4. This is possible because the scraper arm 72 is free to pivot on pivot post 74. As the PCA carrier 62 completes its move to the active position, the lifter 90 pulls away from the cam follower support 92, allowing the scraper arm 72 to lower due to gravity and the downward force provided by the torsion spring 80. The target 66 clears the scraper 78 prior to this lifting and lowering of the scraper arm 72. Now, the target 66, free of ink residue and debris, is in the activated position, as shown in FIG. 3, to take another ink drop detection measurement.

At all times while the printheads 44, 46 are uncapped, this uni-directional waste ink removal system 71 provides clearance for the inkj et carriage 36 to move along carriage guide rod 32 and into the printzone 30 for printing. Using information from the ink drop detector measurements, print masks may be adjusted by controller 26 to replace clogged nozzles for optimum image quality.

A uni-directional waste ink removal system 71, used in conjunction with an electrostatic ink drop detector 58, provides the ability to remove ink residue from the target 66 before it dries. A uni-directional waste ink removal system 71 also provides the ability to remove dried-ink buildup before it has a chance to form stalagmites, thereby preventing damage to the printheads 44, 46. Additionally, a uni-directional waste ink removal system 71 provides the ability to remove dried ink residue in a consistent, single direction, thus preventing debris previously scraped off of the electrostatic sensing target 66 by scraper 78 from being redeposited on the target 66 as it moves into position for a new measurement. Therefore, a uni-directional waste ink removal system 71 enables a printing mechanism to reliably use ink drop detection readings to provide users with consistent, high-quality, and economical inkjet output despite printheads 44, 46 which may clog over time. In discussing various components of the unidirectional waste ink removal system 71, ink drop detector system 58, and the service station 48, various benefits have been noted above.

It is apparent that a variety of other modifications and substitutions may be made to construct a uni-directional waste ink removal system depending upon the particular implementation, while still falling within the scope of the claims below.

We claim:

1. A waste ink removal system for cleaning residue from an ink drop detection sensor in a printing mechanism, comprising:

a frame;

a carrier which supports the sensor and which is slideably supported by the frame;

an actuator which moves the carrier between an activated position and a storage position;

an absorber pivotally supported by the frame, to selectively contact the sensor and remove ink residue therefrom when the sensor is in the storage position; and a scraper pivotally supported by the frame to scrape ink residue from the sensor as the carrier moves from the storage position to the activated position.

2. A waste ink removal system according to claim 1 wherein the actuator comprises an inkjet printhead servicing member which moves between a first position and a second position.

3. A waste ink removal system according to claim 2 further comprising:

a scraper arm pivotally supported by the frame, which supports the scraper and the absorber; and a spring member, connected between the fame and the scraper arm to bias the scraper arm in a direction to allow the scraper and the absorber to interfere with the carrier.

4. A waste ink removal system according to claim 3 wherein:

the scraper arm further comprises a cam follower;

the carrier further comprises a cam which lifts the scraper arm through contact between the cam follower and the cam while the carrier moves from the storage position to the activated position;

the cam follower clears the cam as the carrier reaches the storage position, while the spring member pivots the absorber into contact with the sensing element on the carrier; and the cam follower passes below the cam while the carrier is moved by the actuator from the storage position to the activated position, allowing the spring member to bias the scraper onto the sensor as the sensor moves with the carrier to the activated position, thereby providing a uni-directional scraping for the sensor.

5. A waste ink removal system according to claim 4, wherein the cam further comprises:

a first cam surface which initially lifts the scraper arm through contact with the cam follower while the carrier is moved from the activated position to the storage position;

a second cam surface which receives the cam follower from the first cam surface as the carrier continues to move from the activated position to the storage position; and wherein the cam follower passes below the second cam surface when the carrier returns from the storage position to the activated position and subsequently passes over the first cam surface just before reaching the activated position.

6. A waste ink removal system according to claim 5 wherein the frame further comprises a guide arm or a plurality of guide arms which slideably support the carrier.

7. A waste ink removal system according to claim 6 wherein the carrier further comprises a printed circuit board with electronics to interface with the sensor.

8. A printing mechanism comprising:

a printhead which selectively ejects ink;

an ink drop sensor which receives ink from the printhead and accumulates an ink residue thereon; and a waste ink removal system for cleaning ink residue from the sensor, the waste ink removal system comprising:

a frame slideably supporting a carrier;

the carrier supporting the sensor;

an actuator which moves the carrier between an activated position and a storage position;

an absorber pivotally supported by the frame, to selectively contact the sensor and remove ink residue therefrom when the sensor is in the storage position; and a scrape pivotally supported by the frame to scrape ink residue from the sensor as the carrier moves from the storage position to the activated position.

9. A printing mechanism according to claim 8 wherein the actuator comprises an inkjet printhead servicing member which moves between a first position and a second position.

10. A printing mechanism according to claim 9 further comprising:

a scraper arm pivotally supported by the frame, which supports the scraper and the absorber; and a spring member, connected between the frame and the scraper arm to bias the scraper arm in a direction to allow scraper and the absorber to interfere with the carrier.

11. A printing mechanism according to claim 10 wherein:

the scraper arm further comprises a cam follower, the carrier further comprises a cam which lifts the scraper arm through contact between the cam follower and the cam while the carrier moves from the storage position to the activated position;

the cam follower clears the cam as the carrier reaches the storage position, while the spring member pivots the absorber into contact with the sensing element on the carrier; and the cam follower passes below the cam while the carrier is moved by the actuator from the storage position to the activated position, allowing the spring member to bias the scraper onto the sensor as the sensor moves with the carrier to the activated position, thereby providing a uni-directional scraper for the sensor.

12. A printing mechanism according to claim 11, wherein the cam further comprises:

a first cam surface which initially lifts the scraper arm through contact with the cam follower while the carrier is moved from the activated position to the storage position;

a second cam surface which receives the cam follower from the first cam surface as the carrier continues to move from the activated position to the storage position; and wherein the cam follower passes below the second cam surface when the carrier returns from the storage position to the activated position and subsequently passes over the first cam surface just before reaching the activated position.

13. A printing mechanism according to claim 12 where the frame further comprises a guide arm or a plurality of guide arms which slideably support the carrier.

14. A printing mechanism according to claim 13 wherein the carrier further comprises a printed circuit board with electronics to interface with the sensor.

15. A method of cleaning ink residue from an ink drop detection sensor in a printing mechanism, comprising:

transitioning the sensor from a storage position and an activated position;

thereafter, scraping the sensor while depositing ink on the sensor and accumulating ink residue thereon;

thereafter, retracting the sensor to the storage position;

thereafter, absorbing the ink residue from the sensor; and thereafter, returning the sensor from the storage position to the activated position.

16. A method according to claim 15 for removing ink residue, further comprising:

while returning the sensor from the storage position to the activated position, scraping ink residue from the sensor.

17. A method according to claim 16 for removing ink residue, further comprising scraping ink residue from the sensor before reaching the activated position.

18. A method according to claim 17 for removing ink residue, further comprising lifting the scraper while retracting the sensor to the storage position.

19. A method according to claim 18 for removing ink residue, wherein lifting the scraper while retracting the sensor to the storage position comprises lifting by pivoting the scraper.

* * * * *

UNITED STATES PATENT AND TRADEMARK OFFICE

CERTIFICATE OF CORRECTION

PATENT NO. : 6,454,374 B1
DATED : September 24, 2002
INVENTOR(S) : Patrick Therien It is certified that error appears in the above-identified patent and that said Letters Patent is hereby corrected as shown below:

Column 10,
Line 46, “residue” should read -- ink residue --;

Column 11,
Line 1, “fame” should read -- frame --.

Signed and Sealed this

Twenty-ninth Day of April, 2003

JAMES E. ROGAN
*Director of the United States Patent and Trademark Office*